US009672712B1

(12) United States Patent
Akers

(10) Patent No.: US 9,672,712 B1
(45) Date of Patent: Jun. 6, 2017

(54) RETROFIT SELF-ANNUNCIATING SPRINKLER

(71) Applicant: William E. Akers, Lorton, VA (US)

(72) Inventor: William E. Akers, Lorton, VA (US)

( * ) Notice: Subject to any disclaimer, the term of this patent is extended or adjusted under 35 U.S.C. 154(b) by 0 days.

(21) Appl. No.: 15/149,018

(22) Filed: May 6, 2016

(51) Int. Cl.

| | |
|---|---|
| ***A62C 35/58*** | (2006.01) |
| ***G08B 17/04*** | (2006.01) |
| ***A62C 35/68*** | (2006.01) |
| ***A62C 99/00*** | (2010.01) |
| ***G10K 5/00*** | (2006.01) |
| ***G10K 7/00*** | (2006.01) |
| ***G08B 29/04*** | (2006.01) |
| ***G08B 29/18*** | (2006.01) |
| ***G08B 3/06*** | (2006.01) |
| ***A62C 35/60*** | (2006.01) |

(52) U.S. Cl.
CPC ..... *G08B 17/04* (2013.01); *A62C 35/605* (2013.01); *A62C 35/68* (2013.01); *A62C 99/0072* (2013.01); *G08B 3/06* (2013.01); *G08B 29/043* (2013.01); *G08B 29/181* (2013.01); *G10K 5/00* (2013.01); *G10K 7/00* (2013.01)

(58) Field of Classification Search
CPC ..... A62C 35/605; A62C 35/68; G08B 17/04
USPC ..... 239/124
See application file for complete search history.

(56) References Cited

U.S. PATENT DOCUMENTS

| | | | | | |
|---|---|---|---|---|---|
| 988,768 | A * | 4/1911 | Goldstein | A62C 35/605 | 169/23 |
| 1,125,407 | A * | 1/1915 | Shipman | A62C 35/605 | 169/23 |
| 1,364,340 | A * | 1/1921 | Wilson | A62C 35/605 | 169/23 |
| 1,738,656 | A * | 12/1929 | Lowe | A62C 35/605 | 169/17 |
| 2,558,175 | A * | 6/1951 | Gieseler | A62C 35/605 | 169/19 |
| 3,727,878 | A * | 4/1973 | Willms | A62C 35/66 | 137/907 |
| 3,990,518 | A * | 11/1976 | Hemme | G08B 17/00 | 169/16 |
| 4,023,164 | A * | 5/1977 | Delaney | G08B 17/04 | 122/504.2 |

(Continued)

*Primary Examiner* — Alexander Valvis
(74) *Attorney, Agent, or Firm* — Anna L. Kinney; Michael W. Ferrell

(57) ABSTRACT

A water-powered residential fire suppression and alarm system is provided. The system comprises a sprinkler head, a water-powered alarm, a fire-resistant transfer line assembly, and a housing assembly. The sprinkler activates upon excessive heat. An unclosable channel connects the alarm with the sprinkler head. The transfer line assembly includes a fire-resistant transfer line connected the alarm and to a multi-port coupling. The multi-port coupling also connects to an existing water fixture. The transfer line assembly is unclosable. The housing assembly has a housing with a vertical span of about 3-12 inches. The sprinkler head and alarm are mounted to the housing assembly and the transfer line assembly is connected to the housing assembly. The transfer line assembly connects to the sprinkler head directly as well as through the alarm. When water is provided to the coupling and the sprinkler head activates, water flows through the transfer line, activating the alarm.

13 Claims, 9 Drawing Sheets

(56) References Cited

U.S. PATENT DOCUMENTS 5,390,744 A * 2/1995 McHugh ..... A62C 35/68
169/16

* cited by examiner

RETROFIT SELF-ANNUNCIATING SPRINKLER

FIELD OF INVENTION

The present invention is drawn to a fire detection and extinguishing device that utilizes existing water fixture outlets, preferably affixed to a wall proximate a washer/dryer installation.

BACKGROUND OF THE INVENTION

As of 2013, residential fires in the U.S. caused an estimated 2,755 deaths, 12,450 injuries, and losses of more than $6.8 billion. (See "Residential Building Fire Trends (2004-2013)", USFA Fire Estimate Summary, Residential Building Fires, FEMA, July 2015.) The National Fire Protection Association (NFPA) estimates that, in the U.S., 16,800 home structure fires involving clothes dryers or washing machines were reported in 2010. (See John R. Hall, Jr., "Home Fires Involving Clothes Dryers and Washing Machines", NFPA Fires Analysis & Research, Quincy, Mass., September 2012.) In 89.6% of clothes dryer fires occurring in residential buildings, an automatic extinguishing system (AES) is not present. (See "Clothes Dryer Fires in Residential Buildings (2008-2010)", Topical Fire Report Series, Vol. 13, Issue 7, FEMA, August 2012.) Dryer fires may occur, for example, due to the presence of excess lint buildup; a worn belt; or a stuck thermostat.

A sprinkler system is present in less than 2% of all existing single family and two-family homes. The costs can be prohibitive in some cases. Estimated costs to install a sprinkler system in new residential construction range from several hundred dollars to a few thousand dollars. (See Hayden Brown, "Economic Analysis of Residential Fire Sprinkler Systems", NISTIR 7277, December 2005.)

While rarely present in a residential setting, commercial sprinkler systems are available but require substantial capital and must be installed by certified professionals. Commercial sprinkler systems may have an annunciator present in the system. In these systems, the annunciator, such as a water motor gong, is typically located on an outside wall and connected at the water source leading to the sprinkler system, i.e., not proximal to a sprinkler head. Commercial annunciators are generally designed to alert fire department personnel to the presence of a fire, rather than to alert occupants of a need to evacuate.

Conventional sprinkler heads are designed to activate only under intense heat. In many well-known sprinklers, the head is equipped with a glass bulb containing liquid which expands with increasing temperature. The bulb bursts when exposed to a trigger temperature threshold, thus activating the sprinkler head and allowing water to flow therethrough.

U.S. Pat. No. 4,930,579 to George provides a portable automatic fire sprinkler for the home using an existing fixture as the water source. The George sprinkler head is suspended, for example by a wire hanger, above a heat system or clothes washer/dryer. George discloses copper tubing or flexible tube for delivering a sufficient amount of water to the sprinkler head. The George sprinkler as disclosed is not positioned in accordance with most residential fire and/or building codes.

United States Application Publication No. 2002/0184786 to Miller II is drawn to a fire arrester for use with a clothes dryer, which disconnects power to the dryer if fire is detected and may also deliver an extinguishing agent to the interior of the dryer. The Miller II device optionally can be used to provide local and/or remote alarms activated by an electronic and/or wireless signal emitted by a detector. Miller II teaches a detector, preferably a smoke detector, located in at least one location in the exhaust path and/or the ventilation path. The Miller II extinguishing agent, such as carbon dioxide, is delivered from a canister to the dryer's air inlet or exhaust vent. Miller II discourages use of water for this purpose, due to a need for extensive plumbing, retrofit of spray nozzles, electrical equipment protection and/or catch basins.

United States Application Publication No. 2003/0010509 to Hoffman teaches a fire extinguishing system for incorporation with a clothes dryer in a home laundry area, or with other large, heat producing appliances. The Hoffman system comprises a fire extinguisher spray head connect to a main water line and is equipped with a fitting including an electronic, automatically-actuated water shutoff valve. The Hoffman system also electronically provides automatic shutoff of the electrical circuit associated with the heat-producing appliance and may optionally electronically actuate a local and/or distant alarm. In one embodiment, the Hoffman system relies on an electrically actuated, normally closed, solenoid valve to provide water to a spray nozzle or head. Hoffman teaches that most or all of the fire extinguisher system is installed within a conventional electrical outlet box.

A need remains for an inexpensive, simple to install, automatic fire extinguishing device and alarm system that is easily positioned in a suitable location, particularly a system that alerts residents to a fire without relying on an electricity source.

SUMMARY OF THE INVENTION

In one embodiment, the present invention is drawn to a water-powered residential fire suppression system. The system comprises a sprinkler head, a fire resistant transfer line assembly, and a housing assembly. The sprinkler head is adapted to activate in response to excessive heat and allow water flow therethrough. The fire resistant transfer line assembly includes a fire-resistant transfer line for connecting to an existing water fixture. The housing assembly includes a housing having a vertical span of about 3 inches to about 12 inches. The sprinkler head is mounted to the housing assembly and the fire resistant transfer line assembly is connected to the housing assembly. Optionally, one or more conduits are also mounted therein. The housing assembly, sprinkler head, and fire resistant transfer line assembly are configured such that the fire resistant transfer line assembly communicates with the sprinkler head.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures.

DETAILED DESCRIPTION OF THE INVENTION

Figure 1:
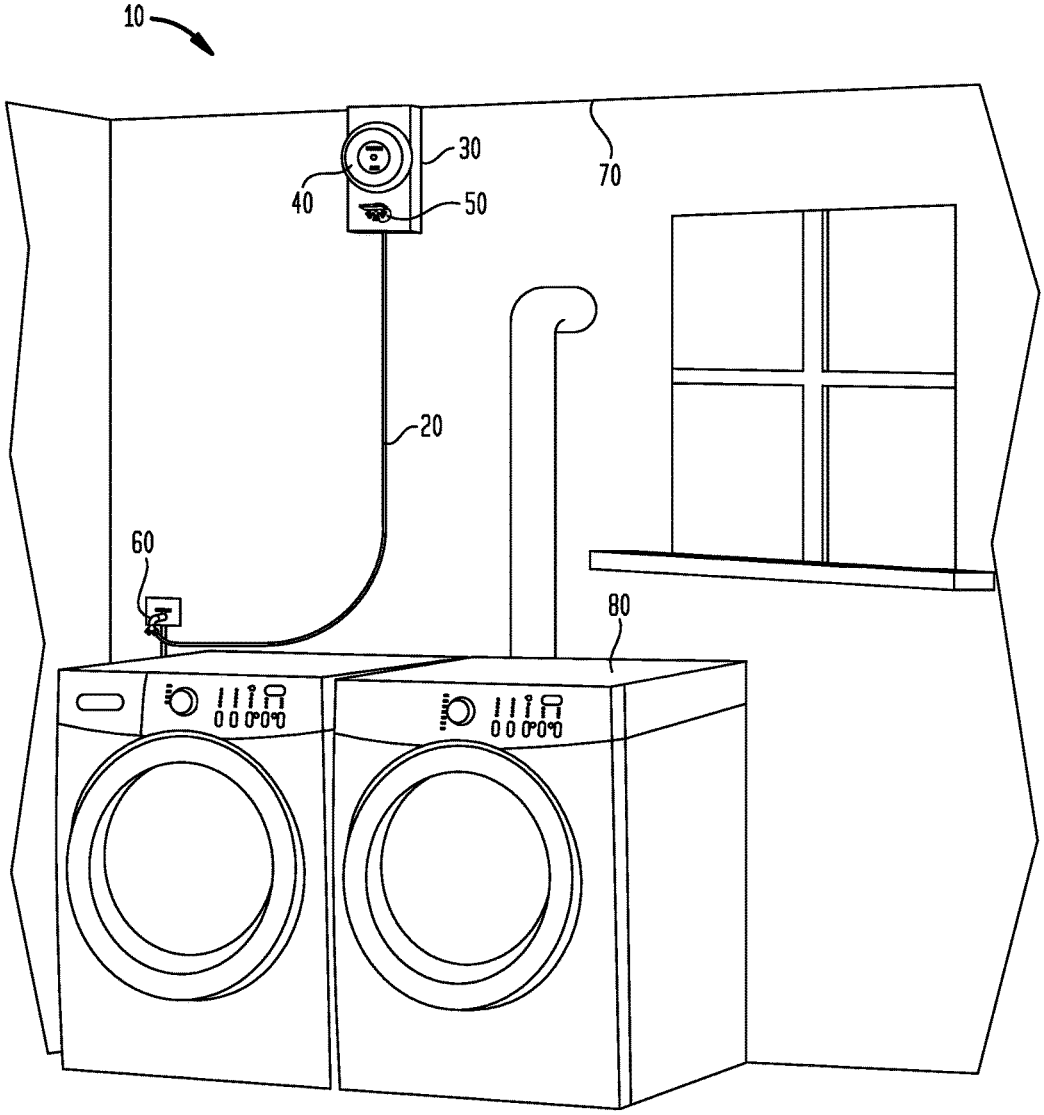
FIG. 1 is visual example illustrating an installed embodiment of the inventive fire suppression system including a water-powered alarm.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

With respect to the various ranges set forth herein, any upper limit recited may, of course, be combined with any lower limit for selected sub-ranges. Similarly, different structural embodiments disclosed herein may be combined unless noted otherwise.

The transitional phrase "consisting essentially of" limits the scope of a claim to the specified materials or steps "and those that do not materially affect the basic and novel characteristic(s)" of the claimed invention. As used herein with respect to process claims, "consisting essentially of" means that the steps are carried out in the recited sequence and exclude steps therebetween that involve substantial reaction of an intermediate or final product; for example, intermediate steps would not involve reaction of more than about 10% of the intermediate product. With respect to product claims, "consisting essentially of" and like terminology refers to the recited components and excludes other ingredients which would substantially change the basic and novel characteristics of the composition or article. Unless otherwise indicated or readily apparent, a composition or article consists essentially of the recited components when the composition or article includes 90% or more by weight of the recited components. That is, the terminology excludes more than 10% unrecited components.

The term "water-powered" as used in the present application refers to the use of a sprinkler and/or alarm which is powered by the kinetic energy present in water flowing from a residential water source. No power from electrical or other non-water sources is required to operate the inventive system.

A Pelton wheel is a water-driven turbine of the class disclosed in U.S. Pat. No. 233,692 to L. A. Pelton. As used herein, the term "Pelton wheel" is intended to encompass water-driven rotors comprising blades or paddles generally.

"Fireproof" or "fire resistant" with respect to tubing means able to withstand a temperature of 225° F. as the maximum working temperature.

As used herein, the phrase "excessive heat" refers to the temperature at which a sprinkler head of the inventive system activates, allowing water to flow. In general, "excessive heat" refers to a temperature of at least about 135° F., such as 142° F. In some embodiments, the sprinkler head may activate at a temperature of at least about 155° F., such as at least about 175° F. or at least about 200° F.

As used herein, "unclosable" means unobstructed and not capable of being obstructed. An "unclosable channel" refers to any hose, lines, conduit, couplings, and the like between the sprinkler head of the invention and an existing water source. In some cases, "unclosable" refers to a Y or tee coupling that has no valves present and thus cannot be intentionally or accidentally closed. An "unclosable channel" prevents deactivation of the inventive sprinkler system. In other words, the water flow to the sprinkler head cannot be blocked, preventing timely release of water in the event of a fire.

As used herein, the term "communicate" refers to a connection between elements of the invention through which water may flow in the event that the system is activated. The elements may be connected directly or may have intervening hose, lines, conduit, couplings, or the like positioned between the elements.

As used herein, the phrase "local fire" refers to a blaze that occurs within the spray area associated with an installed sprinkler head. Preferably, "local" refers to an area of less than 225 square feet in which the sprinkler head is installed.

The present invention is drawn to an inexpensive, easily installed fire suppression system including a sprinkler head mounted to a wall, post, column, or ceiling in the vicinity of a residential heat source, such as a clothes dryer, water heater, or furnace. The inventive device is designed for use with existing water fixtures having standard "garden-hose" threads and standard ¾" diameter in residential settings.

The inventive article comprises a sidewall sprinkler head with a deflector to direct discharged water towards the source of the heat in the event of a fire. The head is generally mounted within a housing and is securely connected to a heat resistant (or fireproof) flexible tube.

The fireproof flexible tube may be braided stainless steel or corrugated stainless steel flexible hose, or the like, of the class including Victaulic® Vic-Flex™ Series AH1 and AH2 Braided Flexible Hose or Vic-Flex® Series AH5 Corrugated Flexible Hose. The inner diameter of the hose is selected such that, upon activation, the sprinkler head is provided with sufficient water to maintain a minimum flow rate of at least about 9.5 gallons per minute (gpm), depending upon the available water pressure at the residential source. Preferably, the hose diameter is sufficient to provide a water flow rate of about 9.5 to about 25 gpm. For example, the nominal diameter may be about ½" to about 1", such as, perhaps, a ¾" diameter. For purposes of the present invention, an initial analysis is based upon the assumption that all of the water flowing through the flexible hose is delivered to the sprinkler head. However, in some embodiments, a minor amount of water is diverted to operate the alarm. In such cases, the hose diameter may be selected to compensate for any change in water pressure and flow rate associated with the alarm.

In some embodiments, the waterproof transfer tubing is provided with ¾" standard garden hose connections at both ends of the hose. In alternative embodiments, an inlet end may be provided with a ¾" standard garden hose connection, while an outlet end may be provided with a ½" pipe thread connection. In either case, an adaptor may be provided at the inlet end, at the outlet end, or at both ends to accommodate water fixture and sprinkler head fittings.

Upon installation, the opposite end of the hose is connected to a multi-port connection such as a "Y" junction, such that a single inlet branch in turn is connected to the water source and the alternate outlet branch is connected to a washing machine water inlet or other appropriate household appliance. No intervening valves are present between the multi-port connection and the water source or in the hose, leaving the water source unobstructed to avoid inadvertently disabling the inventive sprinkler device. Therefore, as long as the water source to the washer or other appliance is on, the system is operatively connected to the water source.

The housing may be manufactured of any suitable material, such as aluminum, steel, or extreme heat-resistant polymer, for example.

In an embodiment, the inventive device mechanically announces that the sprinkler is in operation. A water-activated annunciator, such as a water motor gong, water-operated whistle or hydraulically driven siren, is incorporated into the device. In other words, water flow operates the annunciation feature of the device. The annunciator may have a turbine, such as a Pelton wheel or bladed rotor, that rotates when water flows through an activated sprinkler head.

In embodiments having a water motor gong or bell, the gong or bell element may be contained within the housing or may be secured to the outside of the housing. In some cases, the gong or bell element may be integrally formed within the housing, such that the alarm sounds as a result of a striking element striking at least a portion of the housing.

In one embodiment, the housing is provided with specific dimensions such that when the top surface of the box is installed tight to a ceiling, the sprinkler head is automatically installed according to the sprinkler head manufacturer's recommendations. The housing allows the sprinkler head to be easily installed within 1 foot of the ceiling and within about 6-10 inches from the wall/ceiling junction as required by many fire and building codes. For example, see NFPA 13D: "Standard for the Installation of Sprinkler Systems in One- and Two-Family Dwellings and Manufactured Homes", 2016, published by the National Fire Protection Association. The housing may have a length of between about 2 inches and about 3 feet, a width of between about 2 inches and about 2 feet, and a height of between about 1 inch and about 1 foot. In some embodiments, the housing may have a substantially circular or spheroid shape, with a diameter of from about 3 inches to about 18 inches, such as, for example, about 12 inches. Exemplary dimensions of the housing may include a box about 6.5" long×about 2.87" wide×about 2.5" high, with flanges about 1" wide and a hole or aperture centered about 1.5" from the housing end having a diameter of about 1". In a preferred embodiment, a label is affixed to the top of the box stating "Box must be mounted with this surface up and this surface touching ceiling", or the like.

The International Code Council (ICC) International Residential Code (IRC) has required fire sprinklers as a standard feature in all new homes since 2009. Adoption varies widely across the United States. However, Maryland, for example, has adopted the requirement for fire sprinklers. The Code of Maryland Regulations (COMAR), Title 05, Subtitle 02, Chapter 07, Regulation 05 adopts the International Building Code (IBC), International Residential Code (IRC), and International Energy Conservation Code (IECC). In addition, many local ordinances in Maryland require sprinkler installation in all single-family and duplex new construction, as documented by the Maryland Codes Administration website with respect to fire code information.

FIG. 1 illustrates one embodiment of the inventive fire suppression system 10 as installed in a residential setting. The inventive system is provided with a fire resistant transfer line 20, a housing assembly 30, a water-operated alarm 40, and a sprinkler head 50. Fire resistant transfer line 20 is attached to an existing water fixture or spigot 60 at one end and to the alarm 40 and the sprinkler head 50 at the distal end. Housing assembly 30 is positioned such that sprinkler head 50 is positioned proximate to ceiling 70 and above clothes dryer 80, i.e., above a heat-generating appliance. If a fire occurs, the resulting extreme heat activates the sprinkler head 50, releasing water obtained from fixture 60 via fire resistant transfer line 20.

Figure 2A:
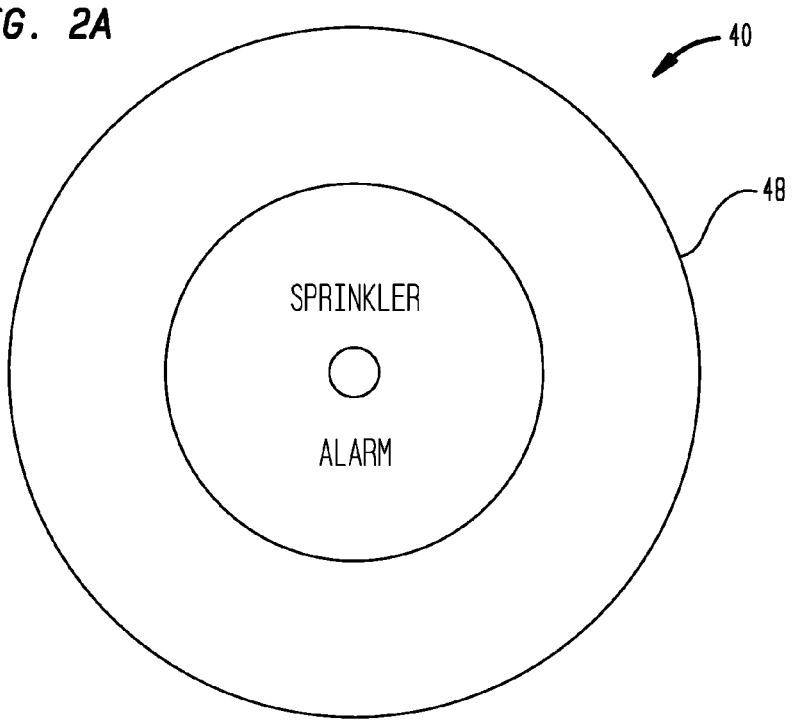
FIGS. 2A and 2B are the front and rear perspective schematics, respectively, of the alarm and housing portions of an embodiment of the inventive system shown in FIG. 1.
Figure 2B:
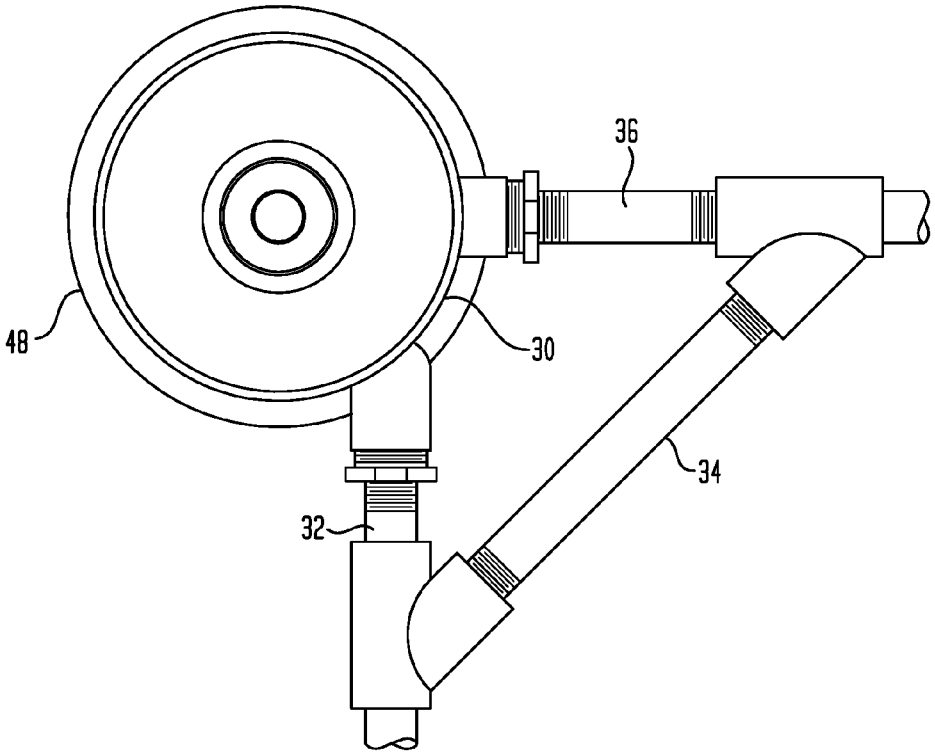

FIG. 2A illustrates a gong or bell 48 element of an alarm 40 according to the invention. FIG. 2B is a schematic illustrating the housing assembly of an alarm-comprising embodiment of the invention as illustrated in FIG. 1, as well as conduit providing water to both the alarm and the sprinkler head. In the embodiment presented in FIG. 2B, the gong element 48 is approximately the same size as the housing assembly 30. In the event that the sprinkler head is activated, water entering the system 10 is delivered to both the alarm 40 of the invention via conduit 32 and to the sprinkler head 50 (see FIG. 1) of the system via conduit 34. Water exits the alarm 40 via conduit 36 and is combined with the water flow from conduit 34 for delivery to the sprinkler head 50.

Figure 3A:
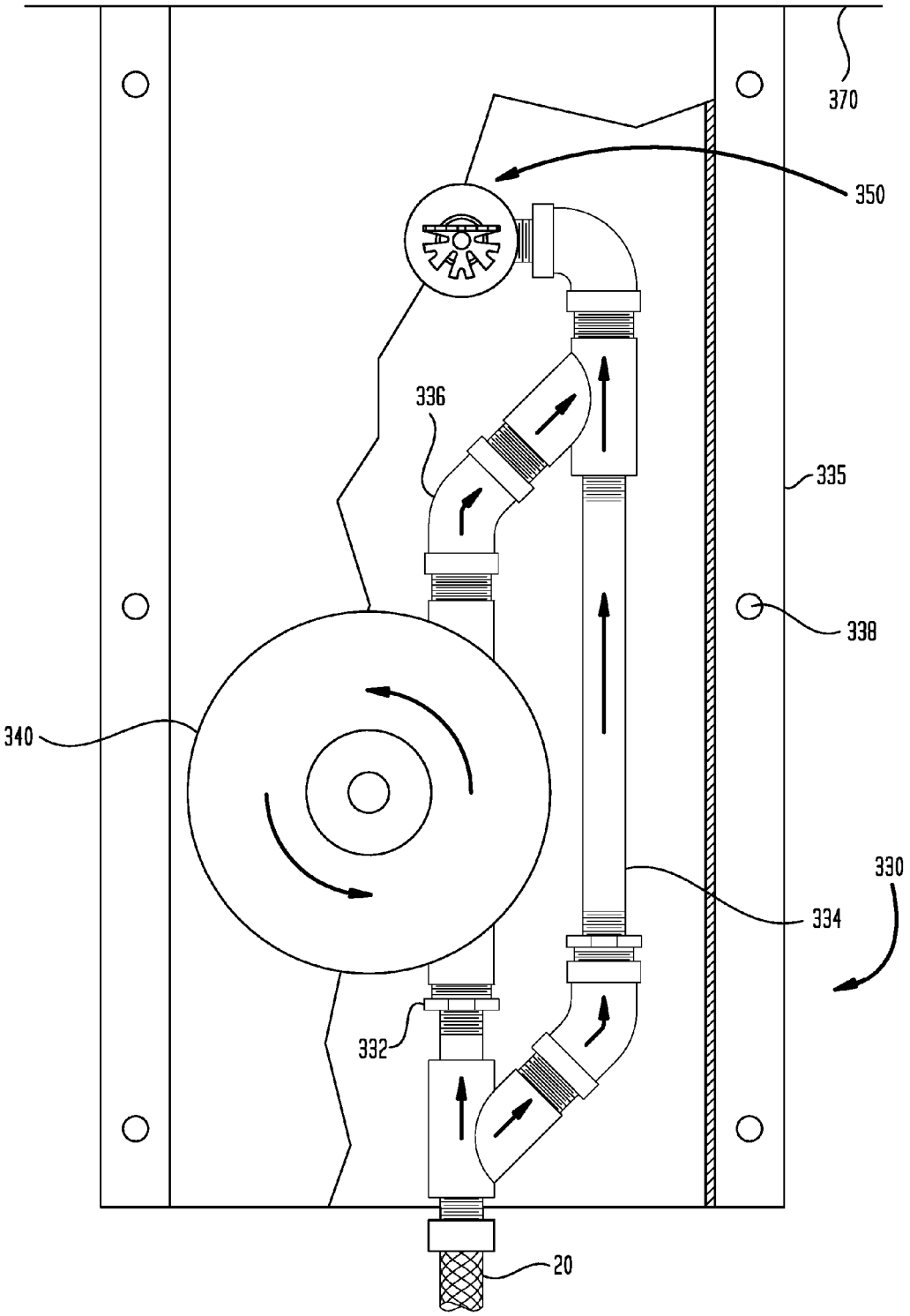
FIG. 3A is a schematic of an alternative configuration to that of FIG. 2B, with the housing cut away to show both the external elements of the device as well as the internal structure and water flow.

FIG. 3A is a front perspective schematic illustrating an alternative configuration of the system with the housing partially cut away. Fire resistant transfer line 20 is connected to the system secured within housing assembly 330, thereby providing water to alarm 340 and sprinkler head 350. FIG. 3A shows the housing assembly 330 positioned abutting the ceiling 370. In the event the sprinkler head 350 is activated, water flows through both conduits 332 and 334. Water from conduit 332 passes through alarm 340, driving a turbine (for example, see FIG. 4), and exits sprinkler head 350 via conduit 336 together with water delivered directly to sprinkler head 350 via conduit 334. Housing assembly 330 is provided with mounting flanges 335 and apertures 338 for securing to a wall with mounting means (for example, see FIG. 6).

Figure 3B:
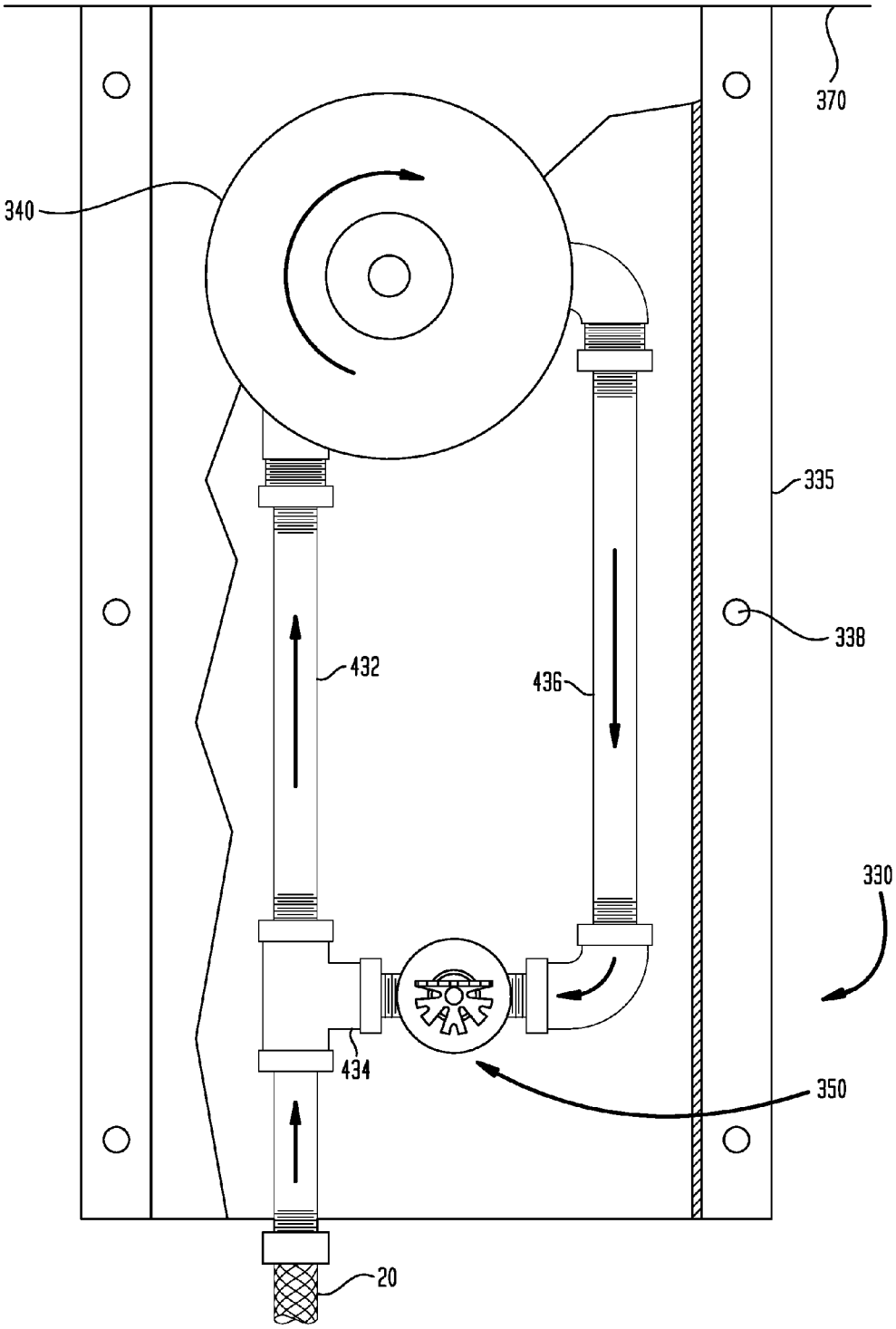
FIG. 3B is a schematic of another alternative configuration to that of FIG. 2B, with the housing cut away to show both the external elements of the device as well as the internal structure and water flow.

FIG. 3B presents another configuration in which the alarm 340 is positioned proximally to the ceiling 370 and the sprinkler head 350 is positioned distally from the ceiling 370. In FIG. 3B, upon activation of the sprinkler head 350, conduit 432 delivers water to the alarm 340, conduit 436 directs water from the alarm 340 to the sprinkler head 350, and conduit 434 delivers water directly to the sprinkler head 350.

Figure 4:
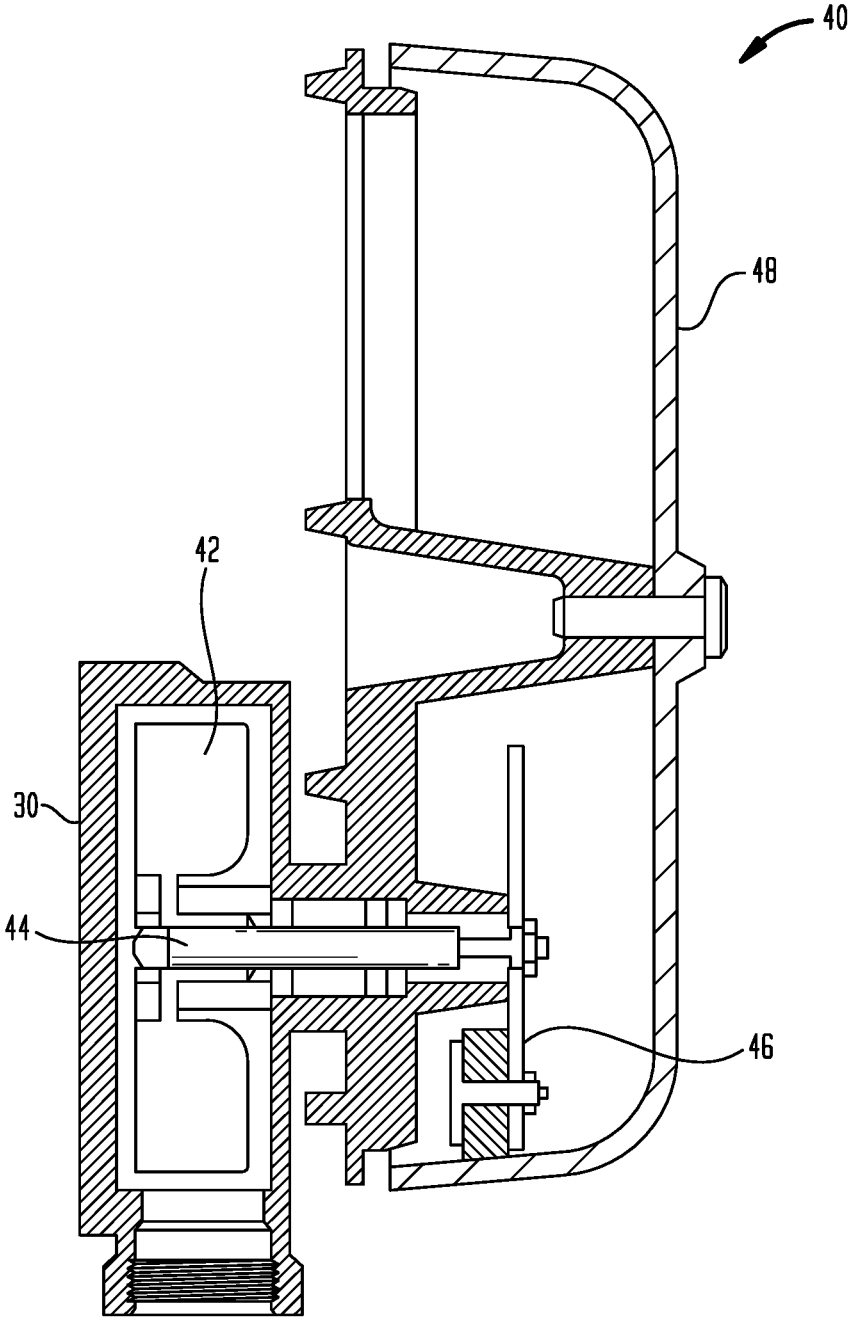
FIG. 4 is a left-side sectional view of the alarm and housing portions of the inventive system shown in FIG. 1.

FIG. 4 further illustrates the alarm components of the fire suppression system shown in FIG. 1. Alarm 40 is integrated into housing assembly 30 and contains a Pelton Wheel 42 connected to a drive shaft 44. Sprinkler head 50 is not visible in this view. The drive shaft 44 communicates with striker assembly 46 within gong 48. When the system is activated, water drives the Pelton Wheel 42, rotating the drive shaft 44, which drives the striker assembly 46. The striker assembly 46 repeatedly strikes the gong 48, alerting residents to the existing fire threat.

Figure 5:
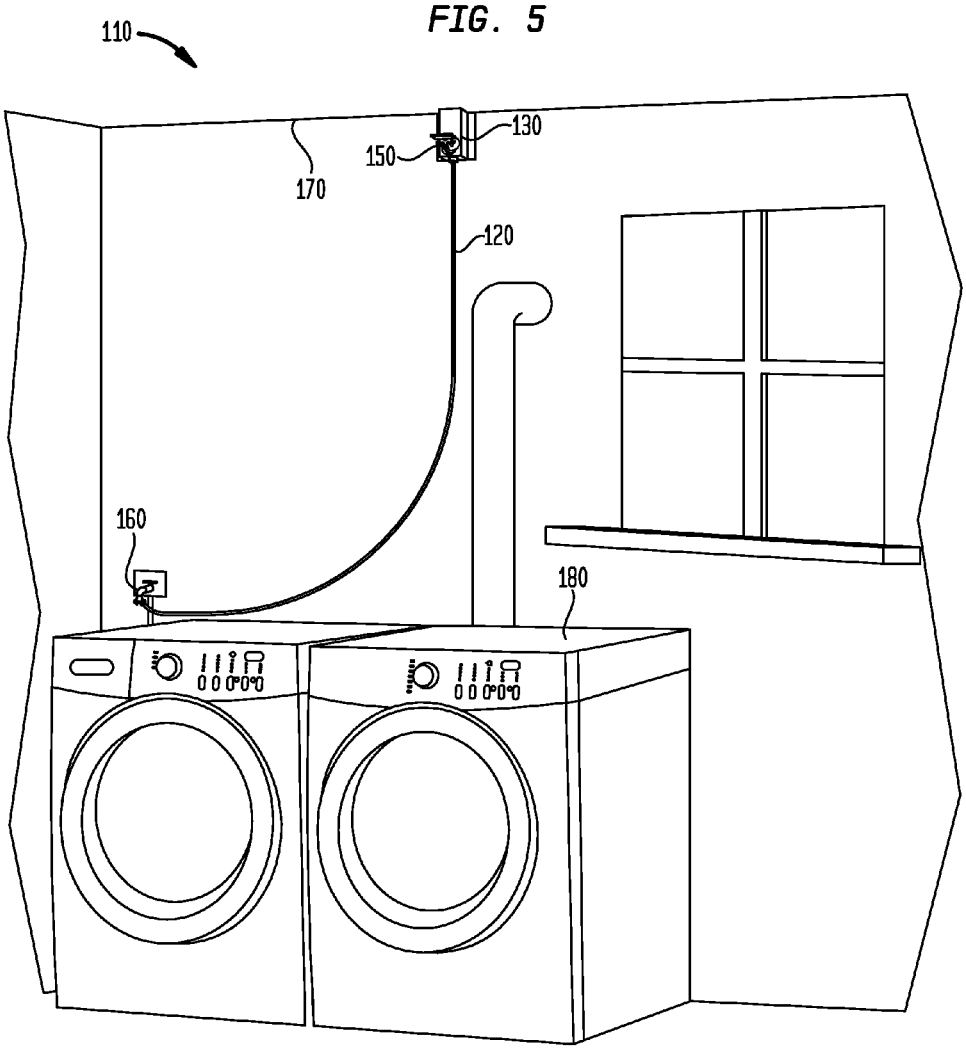
FIG. 5 is a visual example illustrating the positioning of the fire suppression system according to one embodiment of the invention.

FIG. 5 illustrates an alternate embodiment of the inventive fire suppression system 110 installed in a residential setting. Fire suppression system 110 is provided with a fire resistant transfer line 120, a housing assembly 130, and a sprinkler head 150. Fire resistant transfer line 120 is attached to an existing water fixture or spigot 160 at one end and to the sprinkler head 150 at the distal end. Housing assembly 130 is positioned such that sprinkler head 150 is positioned proximate to ceiling 170 and above clothes dryer 180, i.e., above a heat-generating appliance. If a fire occurs, the resulting extreme heat activates the sprinkler head 150, releasing water obtained from fixture 160 via fire resistant transfer line 120.

Figure 6:
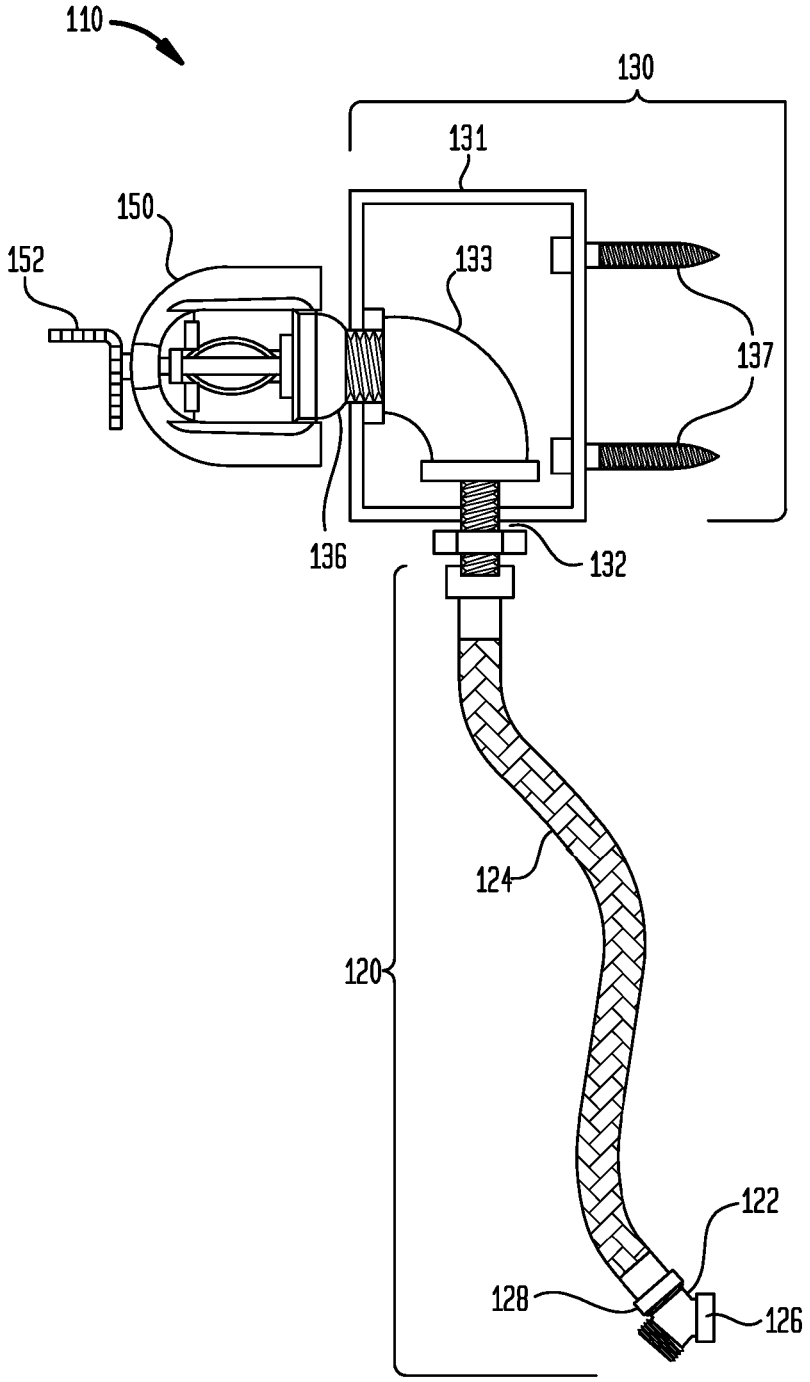
FIG. 6 is a sectional view of the fire extinguishing system of the invention with unclosable coupling and hose as well as a housing with fastening means.

FIG. 6 is a schematic showing an embodiment of the fire extinguishing system 110 with housing 131 partly cut away to show further detail. Fire resistant transfer line assembly 120 comprises a multi-port coupling 122 and fire-resistant hose 124. Multi-port coupling has at least an inlet port 126 and at least one outlet port 128, the outlet port securely fastened to the fire-resistant hose 124. The multiport coupling 122 of the embodiment shown in FIG. 6 is provided with one inlet port and two outlet ports for exemplary purposes. Housing assembly 130 comprises a housing 131, conduit 133 with an inlet 132 and outlet 136, and fastening means 137; screws are shown for exemplary purposes. Sprinkler head 150 is provided with a deflector 152 to direct discharged water away from the ceiling 170 (see FIG. 5) and toward any fire that may occur. Fire-resistant hose 124 is secured to housing assembly 130 at conduit inlet 132 and sprinkler head 150 is secured to housing assembly 130 at conduit outlet 136.

The phrase "fastening means" includes, but is not limited to, brackets secured to a surface with nails, screws, bolts, and/or hooks, as well as double-sided adhesive tape, hook-and-loop closures, or other adhesive material.

Figure 7A:
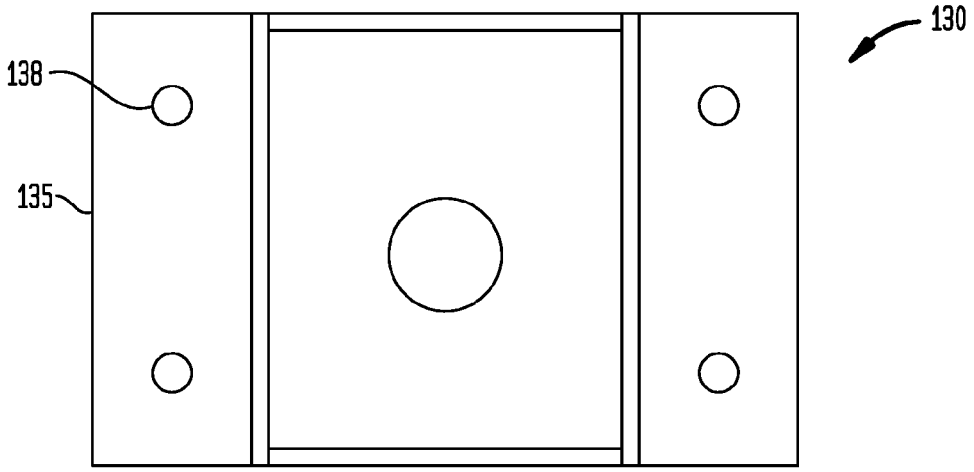
FIGS. 7A, 7B, and 7C are front, bottom, and left perspective views, respectively, of the housing according to one embodiment of the invention.
Figure 7B:
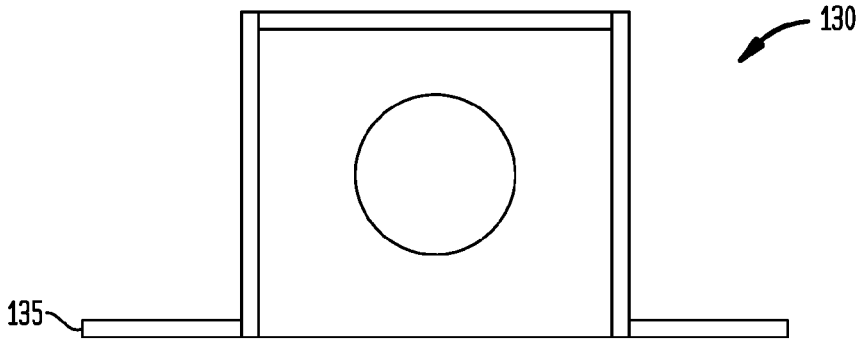
Figure 7C:
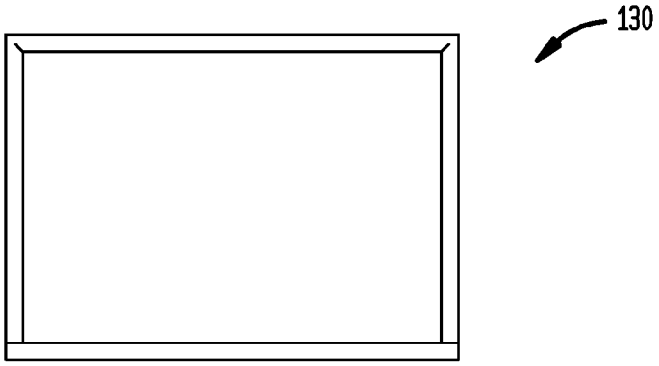

FIGS. 7A, 7B, and 7C show various views of an embodiment of the housing assembly 130. FIG. 7A provides a front view of a housing assembly according to the invention, including a flange 135 with apertures 138 for use with fastening means 137 as shown in FIG. 6.

Figure 8A:
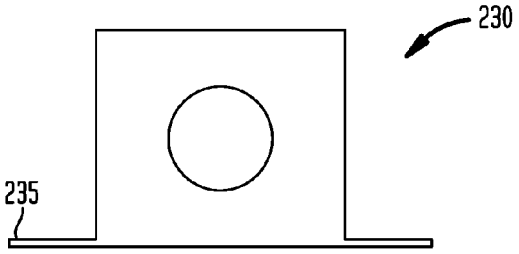
FIGS. 8A, 8B, and 8C are bottom, front, and right perspective views, respectively, of the housing according to another embodiment of the invention.
Figure 8B:
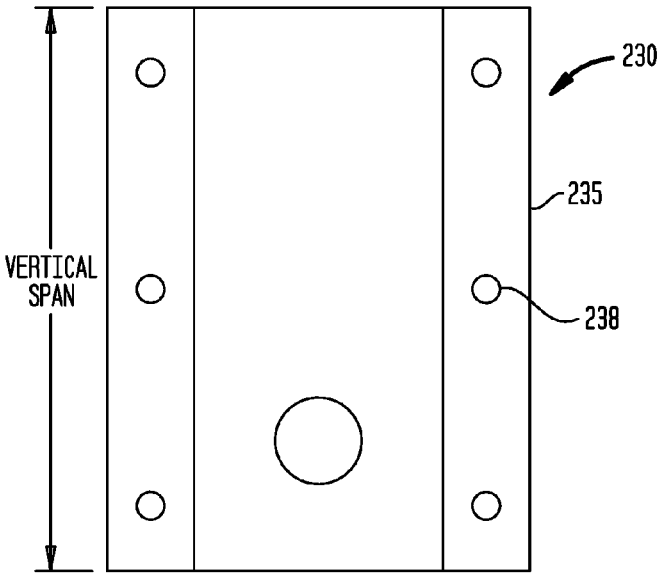
Figure 8C:
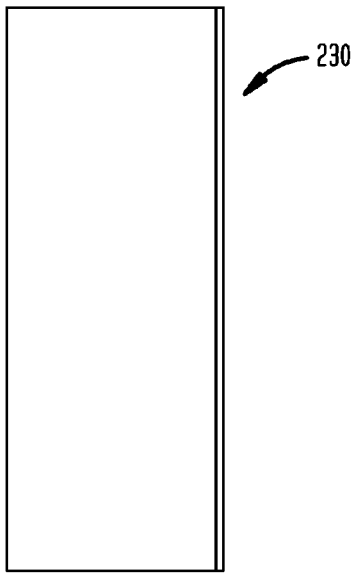

FIGS. 8A, 8B, and 8C show a housing assembly 230 similar to the embodiment of FIGS. 7A-7C. However, the housing assembly 230 of FIGS. 8A-8C is provided with a longer vertical span. Housing assembly 230 is also provided with a flange 235 having apertures 238 for use with fastening means (for example, see FIG. 6). The vertical span of housing assembly 230 shown in FIGS. 8A-8C is predetermined to assure that when housing assembly 230 is positioned abutting a ceiling-to-wall joint, the sprinkler head (see FIG. 5) is positioned in a preferred location.

EMBODIMENTS OF THE INVENTION

There is thus provided in accordance with the invention in one aspect, embodiment No. 1 which is directed to a water-powered residential fire suppression and alarm system adapted to avoid inadvertent deactivation comprising:

(a) a sprinkler head adapted to activate in response to excessive heat and allow water flow therethrough;

(b) a water-powered alarm communicating with the sprinkler head through an unclosable channel;

(c) a fire resistant transfer line assembly including a fire-resistant transfer line communicating with the water-powered alarm and connected to a multi-port coupling by way of a first port, the multi-port coupling also including a second port for connecting to an existing water fixture, the fire resistant transfer line assembly being configured such that it is unclosable with respect to flow between said first and second ports and the water powered alarm; and (d) a housing assembly having a housing with a vertical span of about 3 inches to about 12 inches, optionally comprising one or more conduits mounted therein, wherein the sprinkler head and the water-powered alarm are mounted to the housing assembly and the fire resistant transfer line assembly is connected to the housing assembly such that it communicates with the sprinkler head independently of as well as through the water powered alarm;

whereby when the second port is connected to a source of water pressure and the sprinkler head is activated to allow flow therethrough, water flows through the transfer line thereby necessarily activating the alarm.

Embodiment No. 2 is the water-powered residential fire suppression and alarm system of Embodiment No. 1, wherein the housing assembly defines the vertical position of the sprinkler head when the housing assembly is installed abutting a ceiling.

Embodiment No. 3 is the water-powered residential fire suppression and alarm system of Embodiment No. 1, wherein the housing has a substantially parallelepiped shape wherein the length is the vertical span and the housing has a width of between about 1-6 inches and a depth of between about 1-5 inches.

Embodiment No. 4 is the water-powered residential fire suppression and alarm system of Embodiment No. 1, wherein the housing assembly has a substantially spheroidal section with a diametric size of about 3-12 inches.

Embodiment No. 5 is the water-powered residential fire suppression and alarm system of Embodiment No. 1, wherein the housing assembly further comprises fastening means to securely fasten the housing assembly to a wall, post, column, or ceiling.

Embodiment No. 6 is the water-powered residential fire suppression and alarm system of Embodiment No. 1, wherein the water-powered alarm is a water motor gong.

Embodiment No. 7 is the water-powered residential fire suppression and alarm system of Embodiment No. 6, wherein the water motor gong is further provided with a Pelton wheel, a drive shaft, a striker assembly, and a gong, adapted such that when water flows through the water-powered alarm, the Pelton wheel rotates the drive shaft, the drive shaft rotates the striker assembly, and the striker assembly strikes the gong.

Embodiment No. 8 is the water-powered residential fire suppression and alarm system of Embodiment No. 1, wherein at least a portion of the water-powered alarm is integrally formed into the housing assembly.

Embodiment No. 9 is the water-powered residential fire suppression and alarm system of Embodiment No. 1, wherein the water-powered alarm is a water-operated whistle or siren.

Embodiment No. 10 is a water-powered residential fire suppression system comprising:

(a) a sprinkler head adapted to activate in response to excessive heat and allow water flow therethrough;

(b) a fire resistant transfer line assembly including a fire-resistant transfer line for connecting to an existing water fixture; and (c) a housing assembly with a housing having a vertical span of about 3 inches to about 12 inches, optionally comprising one or more conduits mounted therein, wherein the sprinkler head is mounted to the housing assembly and the fire resistant transfer line assembly is connected to the housing assembly, wherein the sprinkler head, housing assembly, and fire resistant transfer line assembly are configured such that the fire resistant transfer line assembly communicates with the sprinkler head.

Embodiment No. 11 is the water-powered residential fire suppression system of Embodiment No. 10, wherein the device is further provided with an unclosable multi-port coupling, such that an inlet of the coupling is adapted to fasten to the existing water fixture and an outlet of the coupling is fastened to the fire-resistant transfer line.

Embodiment No. 12 is the water-powered residential fire suppression system of Embodiment 11, wherein the unclosable multi-port coupling, the transfer line and the housing assembly have an absence of shutoff valves, thereby avoiding accidental disabling of the device.

Embodiment No. 13 is the water-powered residential fire suppression system of Embodiment No. 10, wherein the sprinkler head is provided with a deflector adapted to direct discharged water in a preferred direction.

Embodiment No. 14 is the water-powered residential fire suppression system of Embodiment No. 10, wherein the system further comprises a water-activated annunciator mounted to the housing, the water-activated annunciator having an inlet port and an outlet port, such that the inlet port of the water-activated annunciator is fastened to the fire-resistant transfer line and the outlet port of the water-activated annunciator is fastened to the sprinkler head.

Embodiment No. 15 is the water-powered residential fire suppression system of Embodiment No. 14, wherein the water-activated annunciator is a water motor gong.

Embodiment No. 16 is the water-powered residential fire suppression system of Embodiment No. 15, wherein the water motor gong is provided with a Pelton wheel, a drive shaft, a striker assembly, and a gong, adapted such that when water flows through the annunciator, the Pelton wheel turns the drive shaft, the drive shaft rotates the striker assembly, and the striker assembly strikes the gong.

Embodiment No. 17 is the water-powered residential fire suppression system of Embodiment No. 14, wherein the water-activated annunciator is a water-operated whistle or water-driven siren.

Embodiment No. 18 is the water-powered residential fire suppression system of Embodiment No. 10, wherein the housing assembly defines the vertical position of the sprinkler head when the housing assembly is installed abutting a ceiling.

Embodiment No. 19 is the water-powered residential fire suppression system of Embodiment No. 10, wherein the housing assembly has a substantially parallelepiped shape wherein the length is the vertical span with a width of between about 1-6 inches and a depth of between about 1-5 inches.

Embodiment No. 20 is the water-powered residential fire suppression system of Embodiment No. 10, wherein the housing assembly has a substantially spheroidal section with a diametric size of about 3-12 inches.

Embodiment No. 21 is the water-powered residential fire suppression system of Embodiment 10, wherein the housing assembly comprises fastening means to securely fasten the housing assembly to a wall, post, column, or ceiling.

Embodiment No. 22 is a method of extinguishing a residential fire, comprising:

(a) installing the water-powered residential fire suppression system of Embodiment No. 10 at a ceiling-to-wall joint above a household appliance that upon operation emits heat, and (b) fastening the fire resistant transfer line assembly to an existing water supply;

whereby, when the sprinkler head is activated to allow flow therethrough, water flows through the transfer line onto the household appliance, thereby extinguishing a local fire.

Embodiment No. 23 is the method of Embodiment No. 22, wherein the household appliance is at least one selected from the group consisting of: a clothes dryer; a water heater; and a furnace.

Embodiment No. 24 is a water-powered residential fire suppression and alarm system adapted to avoid inadvertent deactivation comprising:

(a) a sprinkler head adapted to activate in response to excessive heat and allow water flow therethrough;

(b) a water-powered alarm communicating with the sprinkler head through an unclosable channel; and (c) a fire resistant transfer line assembly including a fire-resistant transfer line communicating with the water-powered alarm and connected to a multi-port coupling by way of a first port, the multi-port coupling also including a second port for connecting to an existing water fixture, the fire resistant transfer line assembly being configured such that it is unclosable with respect to flow between said first and second ports and the water powered alarm;

whereby when the second port is connected to a source of water pressure and the sprinkler head is activated to allow flow therethrough, water flows through the transfer line thereby necessarily activating the alarm.

Embodiment No. 25 is the water-powered residential fire suppression and alarm system of Embodiment No. 24, wherein the water-powered alarm is a water motor gong.

Embodiment No. 26 is the water-powered residential fire suppression and alarm system of Embodiment No. 25, wherein the water motor gong is further provided with a Pelton wheel, a drive shaft, a striker assembly, and a gong, adapted such that when water flows through the water-powered alarm, the Pelton wheel rotates the drive shaft, the drive shaft rotates the striker assembly, and the striker assembly strikes the gong.

Embodiment No. 27 is the water-powered residential fire suppression and alarm system of Embodiment No. 24, wherein at least a portion of the water-powered alarm is integrally formed into the housing assembly.

Embodiment No. 28 is the water-powered residential fire suppression and alarm system of Embodiment No. 24, wherein the water-powered alarm is a water-operated whistle or siren.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. For example, the inventive device may, in one combined embodiment, be provided with a flexible hose, a housing having dimensions conducive to correct installation in compliance with fire and building codes, and a water-activated annunciator integral to the housing. Furthermore, those of ordinary skill in the art will appreciate that the foregoing description is by way of example only, and is not intended to limit the invention.

What is claimed is:

1. A water-powered residential fire suppression and alarm system in the form of a retrofit kit for installing in a residential dwelling and connecting to an existing water fixture in the form of an existing spigot already installed in the dwelling, consisting essentially of:

(a) a single sprinkler head;

(b) a water-powered alarm having a water inlet and a water outlet, said alarm being configured such that it emits an audible alarm when water flows between the inlet and the outlet;

(c) a fire resistant transfer line assembly including a fire-resistant transfer line communicating with the water-powered alarm and connected to a multi-port coupling by way of a first port, the multi-port coupling also including a second port configured to connect to an existing residential water fixture, the fire resistant transfer line assembly being configured such that it is unclosable with respect to flow between said first and second ports and the water powered alarm, said fire resistant transfer line assembly further providing flow from the existing residential water fixture to the single sprinkler head through an unclosable flow path; and (d) a housing assembly having a housing with a vertical span of about 3 inches to about 12 inches, having one or more conduits mounted therein, wherein the sprinkler head and the water-powered alarm are mounted to the housing assembly and the fire resistant transfer line assembly is connected to the housing assembly such that it communicates with the sprinkler head independently of as well as through the water powered alarm;

whereby when the second port is connected to a source of water pressure and the sprinkler head is activated to allow flow therethrough, water flows through the transfer line thereby necessarily activating the alarm;

and wherein the outlet of said water-powered alarm provides a flow channel to the sprinkler head when said sprinkler head is activated.

2. The water-powered residential fire suppression and alarm system of claim 1, wherein the housing assembly defines the vertical position of the sprinkler head when the housing assembly is installed abutting a ceiling.

3. The water-powered residential fire suppression and alarm system of claim 1, wherein the housing has a substantially parallelepiped shape wherein the length is the vertical span and the housing has a width of between about 2-6 inches and a depth of between about 1-5 inches.

4. The water-powered residential fire suppression and alarm system of claim 1, wherein the housing assembly further comprises fastening means to securely fasten the housing assembly to a wall, post, column, or ceiling.

5. The water-powered residential fire suppression and alarm system of claim 1, wherein the water-powered alarm is a water motor gong.

6. The water-powered residential fire suppression and alarm system of claim 5, wherein the water motor gong is further provided with a Pelton wheel, a drive shaft, a striker assembly, and a gong, adapted such that when water flows through the water-powered alarm, the Pelton wheel rotates the drive shaft, the drive shaft rotates the striker assembly, and the striker assembly strikes the gong.

7. A water-powered residential fire suppression and alarm system in the form of a retrofit kit for installing in a residential dwelling and connecting to an existing water fixture in the form of an existing spigot already installed in the dwelling, consisting essentially of:

(a) a single sprinkler head adapted to activate in response to excessive heat and allow water flow therethrough;

(b) a water-powered alarm having a water inlet and a water outlet, said alarm being configured such that it emits an audible alarm when water flows between the inlet and the outlet; and (c) a fire resistant transfer line assembly including a fire-resistant transfer line communicating with the water-powered alarm and connected to a multi-port coupling by way of a first port, the multi-port coupling also including a second port configured to connect to an existing residential water fixture, the fire resistant transfer line assembly being configured such that it is unclosable with respect to flow between said first and second ports and the water powered alarm, said fire resistant transfer line assembly further providing flow from the existing residential water fixture to the single sprinkler head through an unclosable flow path;

whereby when the second port is connected to a source of water pressure and the sprinkler head is activated to allow flow therethrough, water flows through the transfer line thereby necessarily activating the alarm;

and wherein the outlet of said water-powered alarm provides a flow channel to the sprinkler head when said sprinkler head is activated.

8. The water-powered residential fire suppression system of claim 7, wherein the unclosable multi-port coupling and the fire resistant transfer line have an absence of shutoff valves, thereby avoiding accidental disabling of the device.

9. The water-powered residential fire suppression system of claim 7, wherein the sprinkler head is provided with a deflector adapted to direct discharged water in a preferred direction.

10. The water-powered residential fire suppression and alarm system of claim 7, wherein the water-powered alarm is a water motor gong.

11. The water-powered residential fire suppression and alarm system of claim 10, wherein the water motor gong is further provided with a Pelton wheel, a drive shaft, a striker assembly, and a gong, adapted such that when water flows through the water-powered alarm, the Pelton wheel rotates the drive shaft, the drive shaft rotates the striker assembly, and the striker assembly strikes the gong.

12. The water-powered residential fire suppression and alarm system of claim 7, wherein water is provided to the sprinkler head independently of as well as via the water-powered alarm.

13. The water-powered residential fire suppression and alarm system of claim 1, wherein the system is unclosable between the sprinkler head and the water-powered alarm with respect to hydraulic flow.

* * * * *